US006280583B1

(12) United States Patent
Woodruff et al.

(10) Patent No.: US 6,280,583 B1
(45) Date of Patent: Aug. 28, 2001

(54) REACTOR ASSEMBLY AND METHOD OF ASSEMBLY

(75) Inventors: Daniel J. Woodruff; Kyle M. Hanson, both of Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 0 days.

(21) Appl. No.: 09/385,784

(22) Filed: Aug. 30, 1999

Related U.S. Application Data

(62) Division of application No. 09/112,300, filed on Jul. 9, 1998.

(51) Int. Cl.[7] ..... C25B 17/00

(52) U.S. Cl. ..... 204/242; 204/275.1; 204/286.1

(58) Field of Search ..... 204/242, 275, 204/286, 297 R, 275.1, 285

(56) References Cited

U.S. PATENT DOCUMENTS

| | | | | |
|---|---|---|---|---|
| 3,798,003 | * | 3/1974 | Ensley et al. | 23/253 R |
| 4,165,252 | | 8/1979 | Gibbs . | |
| 4,466,864 | | 8/1984 | Bacon et al. . | |
| 4,585,539 | | 4/1986 | Edson . | |

(List continued on next page.)

FOREIGN PATENT DOCUMENTS

| | | |
|---|---|---|
| 41 14 427 A1 | 11/1992 | (DE) . |
| 9-2628886 | 4/1997 | (JP) . |
| WO00/03072 | 1/2000 | (WO) . |
| WO00/40779 | 7/2000 | (WO) . |

OTHER PUBLICATIONS

Sybil P. Parker, Editor in Chief; McGraw–Hill, Inc.; McGraw–Hill Dictionary of Scientific and Technical Terms; Fifth Edition; ISBN 0–07–042333–4; 1997 definition of "bayonet coupling" No month available.

08/991069, U.S Application Serial Number, filed Dec. 15, 1997, 5985126 US Patent No.

Buehler Simplimet 2 and Simplimet 2000 Product Literature—FN00682 and FN00935, No month Available—(Est 1996).

*Primary Examiner*—Kathryn Gorgos
*Assistant Examiner*—J. Maisano
(74) *Attorney, Agent, or Firm*—Perkins Coie LLP

(57) ABSTRACT

An improved anode, cup and conductor assembly for a reactor vessel includes an anode assembly supported within a cup which holds a supply of process fluid. The anode assembly has an anode shield carrying an anode, the anode shield having upwardly extending brackets with radially extending members. A diffusion plate is supported above the anode by the anode brackets using first bayonet connections. The anode shield and the anode are supported from below by a delivery tube which also serves to deliver process fluid to the cup. A second bayonet connection is provided between a top portion of the delivery tube and the anode assembly. The conductor is connected to the anode with a plug-in connection which is completed when the tube is coupled to the anode by the second bayonet connection. The diffusion plate and the anode assembly are installable and removable from a top side of the reactor vessel using a tool which is lockable to the diffusion plate or to the anode. The tool provides a handle for manual engagement or disengagement of the first and second bayonet connections.

31 Claims, 13 Drawing Sheets

U.S. PATENT DOCUMENTS

| | | | | |
|---|---|---|---|---|
| 4,696,729 | | 9/1987 | Santini . | |
| 4,741,624 | * | 5/1988 | Barroyer | 306/165 |
| 4,868,992 | | 9/1989 | Crafts et al. . | |
| 5,024,746 | * | 6/1991 | Stierman et al. | 204/297 |
| 5,169,408 | | 12/1992 | Biggerstaff et al. . | |
| 5,227,041 | * | 7/1993 | Brogden et al. | 204/297 R |
| 5,271,972 | | 12/1993 | Kwok et al. . | |
| 5,332,271 | | 7/1994 | Grant et al. . | |
| 5,340,456 | | 8/1994 | Mehler . | |
| 5,391,285 | * | 2/1995 | Lytle et al. | 205/123 |
| 5,405,518 | | 4/1995 | Hsieh et al. . | |
| 5,427,674 | | 6/1995 | Langenskiöld et al. . | |
| 5,441,629 | * | 8/1995 | Kosaki | 205/148 |
| 5,447,615 | | 9/1995 | Ishida . | |
| 5,514,258 | * | 5/1996 | Brinket et al. | 204/237 |
| 5,829,791 | * | 11/1998 | Kutsubo et al. | 285/26 |
| 5,985,126 | | 11/1999 | Bleck et al. . | |
| 6,027,631 | | 2/2000 | Broadbent . | |

* cited by examiner

REACTOR ASSEMBLY AND METHOD OF ASSEMBLY

CROSS-REFERENCE TO RELATED APPLICATIONS

This application is a divisional application of Ser. No. 09/112,300, filed Jul. 9, 1998, pending.

STATEMENT REGARDING FEDERALLY SPONSORED RESEARCH OR DEVELOPMENT

Not applicable

BACKGROUND OF THE INVENTION

In the production of semiconductor integrated circuits and other semiconductor articles from semiconductor wafers, it is often necessary to provide multiple metal layers on the wafer to serve as interconnect metallization which electrically connects the various devices on the integrated circuit to one another. Traditionally, aluminum has been used for such interconnects, however, it is now recognized that copper metallization may be preferable.

The semiconductor manufacturing industry has applied copper onto semiconductor wafers by using a "damascene" electroplating process where holes, commonly called "vias", trenches and/or other recesses are formed onto a substrate and filled with copper. In the damascene process, the wafer is first provided with a metallic seed layer which is used to conduct electrical current during a subsequent metal electroplating step. The seed layer is a very thin layer of metal which can be applied using one or more of several processes. For example, the seed layer of metal can be laid down using physical vapor deposition or chemical vapor deposition processes to produce a layer on the order of 1,000 angstroms thick. The seed layer can advantageously be formed of copper, gold, nickel, palladium, or other metals. The seed layer is formed over a surface which is convoluted by the presence of the vias, trenches, or other recessed device features.

A copper layer is then electroplated onto the seed layer in the form of a blanket layer. The blanket layer is plated to an extent which forms an overlying layer, with the goal of providing a copper layer that fills the trenches and vias and extends a certain amount above these features. Such a blanket layer will typically be formed in thicknesses on the order of 10,000 to 15,000 angstroms (1–1.5 microns).

After the blanket layer has been electroplated onto the semiconductor wafer, excess metal material present outside of the vias, trenches, or other recesses is removed. The metal is removed to provide a resulting pattern of metal layer in the semiconductor integrated circuit being formed. The excess plated material can be removed, for example, using chemical mechanical planarization. Chemical mechanical planarization is a processing step which uses the combined action of a chemical removal agent and an abrasive which grinds and polishes the exposed metal surface to remove undesired parts of the metal layer applied in the electroplating step.

The electroplating of the semiconductor wafers takes place in a reactor assembly. In such an assembly an anode electrode is disposed in a plating bath, and the wafer with the seed layer thereon is used as a cathode. Only a lower face of the wafer contacts the surface of the plating bath. The wafer is held by a support system that also conducts the requisite cathode current to the wafer. The support system may comprise conductive fingers that secure the wafer in place and also contact the wafer in order to conduct electrical current for the plating operation.

One embodiment of a reactor assembly is disclosed in U.S. Ser. No. 08/988,333 filed Sep. 30, 1997, now U.S. Pat. No. 5,985,126 entitled "Semiconductor Plating System Workpiece Support Having Workpiece—Engaging Electrodes With Distal Contact Part and Dielectric Cover." FIG. 1 illustrates such an assembly. As illustrated the assembly 10 includes reactor vessel 11 for electroplating a metal, a processing head 12 and an electroplating bowl assembly 14.

As shown in FIG. 1, the electroplating bowl assembly 14 includes a cup assembly 16 which is disposed within a reservoir chamber 18. Cup assembly 16 includes a fluid cup 20 holding the processing fluid for the electroplating process. The cup assembly of the illustrated embodiment also has a depending skirt 26 which extends below a cup bottom 30 and may have flutes open therethrough for fluid communication and release of any gas that might collect as the reservoir chamber fills with liquid. The cup can be made from polypropylene or other suitable material.

A bottom opening in the bottom wall 30 of the cup assembly 16 receives a polypropylene riser tube 34 which is adjustable in height relative thereto by a threaded connection between the bottom wall 30 and the tube 34. A fluid delivery tube 44 is disposed within the riser tube 34. A first end of the delivery tube 44 is secured by a threaded connection 45 to an anode 42. An anode shield 40 is attached to the anode 42 by screws 74. The delivery tube 44 supports the anode within the cup. The fluid delivery tube 44 is secured to the riser tube 34 by a fitting 50. The fitting 50 can accommodate height adjustment of the delivery tube 44 within the riser tube. As such, the connection between the fitting 50 and the riser tube 34 facilitates vertical adjustment of the delivery tube and thus the anode vertical position. The delivery tube 44 can be made from a conductive material, such as titanium, and is used to conduct electrical current to the anode 42 as well as to supply fluid to the cup.

Process fluid is provided to the cup through the delivery tube 44 and proceeds therefrom through fluid outlet openings 56. Plating fluid fills the cup through the openings 56, supplied from a plating fluid pump (not shown).

An upper edge of the cup side wall 60 forms a weir which limits the level of electroplating solution or process fluid within the cup. This level is chosen so that only the bottom surface of the wafer W is contacted by the electroplating solution. Excess solution pours over this top edge into the reservoir chamber 18. The level of fluid in the chamber 18 can be maintained within a desired range for stability of operation by monitoring and controlling the fluid level with sensors and actuators. One configuration includes sensing a high level condition using an appropriate switch 63 and then draining fluid through a drain line controlled by a control valve (not shown). The out flow liquid from chamber 18 can be returned to a suitable reservoir. The liquid can then be treated with additional plating chemicals or other constituents of the plating or other process liquid, and used again.

A diffusion plate 66 is provided above the anode 42 for providing a more controlled distribution of the fluid plating bath across the surface of wafer W. Fluid passages in the form of perforations are provided over all, or a portion of, the diffusion plate 66 to allow fluid communication therethrough. The height of the diffusion plate within the cup assembly is adjustable using threaded diffusion plate height adjustment mechanisms 70.

The anode shield 40 is secured to the underside of the consumable anode 42 using anode shield fasteners 74. The anode shield prevents direct impingement on the anode by the plating solution as the solution passes into the processing chamber. The anode shield 40 and anode shield fasteners 74 can be made from a dielectric material, such as polyvinylidene fluoride or polypropylene. The anode shield serves to electrically isolate and physically protect the backside or the anode. It also reduces the consumption of organic plating liquid additives.

The processing head 12 holds a wafer W for rotation about a vertical axis R within the processing chamber. The processing head 12 includes a rotor assembly having a plurality of wafer-engaging fingers 89 that hold the wafer against holding features of the rotor. Fingers 89 are preferably adapted to conduct current between the wafer and a plating electrical power supply and act as current thieves. Portions of the processing head 12 mate with the processing bowl assembly 14 to provide a substantially closed processing volume 13.

The processing head 12 can be supported by a head operator. The head operator can include an upper portion which is adjustable in elevation to allow height adjustment of the processing head. The head operator also can have a head connection shaft which is operable to pivot the head 12 about a horizontal pivot axis. Pivotal action of the processing head using the operator allows the processing head to be placed in an open or faced-up position (not shown) for loading and unloading wafer W.

Processing exhaust gas must be removed from the volume 13. FIGS. 1 and 2 illustrate an outer vessel side wall 76 that extends upwardly from the vessel base plate 75 to a top end into which is nested an intermediate exhaust ring 77 having circumferentially spaced-apart slots 78 therethrough. The slots 78 communicate exhaust gas from inside the vessel 13 to a thin annular plenum 79 located between the intermediate exhaust ring 77 and the outer bowl side wall 76. Surrounding the outer bowl side wall 76 is a vessel ring assembly 80 which forms with the side wall 76 an external, annular collection chamber 81. Gas which is collected in the plenum 79 passes through intermittent orifices 82 and into the annular collection chamber 81. Gas collected in the collection chamber 81 is passed through an exhaust nozzle 83 to be collected and recycled.

The above described apparatus can suffer from some drawbacks. The threaded connection 45 of the anode and the delivery tube may introduce some risk of thread damage during maintenance or installation of a new anode onto the delivery tube. This type of construction also makes the rotational engagement and installation of, or the disengagement and removal of, the anode to/from the delivery tube difficult and time consuming, due to the heavy weight of the anode and the tight clearances between the anode 42 and the cup sidewall 60. The threaded connection requires a sufficient number of anode rotations for a complete threaded engagement during assembly, or complete threaded disengagement during disassembly.

Additionally, in electroplating processes using a consumable anode, it is desired to have an anodic film deposited on a surface of the anode. This film is applied to the anode before wafer processing. However, this anodic film is very fragile and any hand or tool contact with the anodic film during engagement or disengagement is likely to damage the film, which must then be re-grown. This makes the threaded, rotational manipulation and handling of the anode during installation or removal particularly difficult. Also, handling the anode assembly or the diffusion plate during the assembly and disassembly can contaminate surfaces of the anode assembly, the diffusion plate, or other inside surfaces within the volume 13.

The threaded height adjustment of the diffusion plate using threaded height adjustment mechanisms 70 also requires a time consuming operation to precisely install the diffusion plate to the anode. A plurality of securements, such as Allen head screws, are required to be removed to disassemble the diffusion plate from the anode and reinstalled during reassembly. This is an important consideration since the diffusion plate must be removed routinely to inspect anodic film formation on the anode. The adjustment of the plural screw mechanisms can also introduce height and level inaccuracies of the diffusion plate with respect to the anode and/or reactor cup.

Also, the cup assembly located inside the reactor vessel is supported by an adjustable threaded engagement with the riser tube. The threaded engagement may introduce cup height and level misadjustments.

The threaded height adjustment of the anode assembly within the cup, by adjusting the delivery tube, can introduce height and levelness misadjustments. Additionally, the delivery tube being vertically adjustable by loosening of a locking nut located below the reactor vessel, requires access to both the top side of the cup for viewing the anode height adjustment, and the bottom side of the vessel to loosen this locking nut. If the reactor vessel is supported on a deck this requires access to both above and below the deck. Additionally, the delivery tube being vertically adjustable at the reactor vessel base plate requires a more complex seal mechanism between the delivery tube and the anode post at the vessel base plate. Also, the delivery tube serving the dual function of being a liquid conduit and an electrical conductor requires the tube to be constructed of a metallic material which is conductive yet substantially inert to the process chemistry. Such a conduit has been composed of titanium, which is costly.

The present inventors have recognized that it would be advantageous to provide a reactor vessel having an improved connection arrangement between anode and diffusion plate, and between anode and anode support structure to avoid some of the foregoing problems. Further, the inventors have recognized that it would be advantageous to provide a reactor vessel arrangement that facilitates easier assembly and disassembly of diffusion plate, anode, anode support structure and anode electrical conductor than found in the foregoing system. Still further, the present inventors have recognized that it would be advantageous to provide a reactor vessel which eliminates threaded connections to as great a degree as possible.

The inventors have recognized that it would be advantageous to provide a reactor vessel having: an improved mechanical connection arrangement between anode and delivery tube, an improved electrical connection between anode and an outside electrical power source, an improved accessibility for adjusting elements of the reactor vessel, an improved accuracy of vertical adjustment between the anode and the cup, and an improved accuracy of vertical and level adjustment of the cup within the reactor vessel.

BRIEF SUMMARY OF THE INVENTION

An improved reactor vessel is disclosed herein. The improved reactor vessel includes a reservoir container having a base with a surrounding container sidewall upstanding from the base. A cup is arranged above the base, the cup having a bottom wall and a surrounding cup sidewall upstanding from the bottom wall, the cup sidewall defining a level of process fluid held within the cup. The cup is supported within the reactor vessel on the surrounding container sidewall substantially around a perimeter of the cup. Unlike the reactor vessel of FIG. 1, which supports the cup at a central location by threaded engagement with the riser tube, the cup of the present invention is supported around its outside perimeter at a precise and stable level with respect to the reactor vessel. An electrode plate, such as a consumable anode, is arranged within the cup below the fluid level.

The reactor vessel includes bayonet style connections between an anode assembly and a difflusion plate, and a bayonet style connection between an anode support structure and the anode assembly. A tool is provided which simplifies the installation and removal of the diffusion plate and the anode assembly, while minimizing the risk of contamination or damage to the anode assembly, diffusion plate, or other surfaces within the reactor vessel.

In one embodiment, the reactor vessel includes as separate pieces, an anode electrical conductor and a fluid delivery tube. The delivery tube functions as the anode support structure for adjustably supporting the anode assembly, and as a conduit for delivering process fluid into the cup surrounding the anode. A corrugated sleeve or tube seals the electrical conductor within the delivery tube.

The fluid delivery tube is fixed at its top end to the anode assembly by a bayonet connection. A protruding tip of the conductor which extends above the delivery tube engages a socket formed in the anode. The engagement of the tip into the socket occurs simultaneously with the engagement of the bayonet connection. A spring within the bellows seal resiliently holds the bayonet connection in its engaged condition and assists in maintaining a sealed connection between the bellows seal and the anode.

The delivery tube is sealed to the base and extends through the cup bottom wall to support the anode assembly from the base. The tube has a substantially closed bottom and a top. The anode electrical conductor includes a conductor wire which is arranged within the tube and passes through the tube bottom and top, the conductor wire being connected to the protruding tip. The tube includes an inlet opening for receiving process fluid, and at least one outlet opening into the cup.

The reactor vessel includes a fixed incremental vertical adjustment and level adjustment between the anode assembly and the reactor cup. A spacer (or spacers) having a desired thickness is (are) interposed between the anode and the delivery tube to set the anode height within the cup. The spacer is C-shaped so as to be installable without complete dismantling of the electrical conductor assembly. The electrical conductor includes an excess length within the delivery tube for the purpose of allowing room for the removal and installation of the C-shaped spacer during level adjustment of the cup.

The anode assembly includes an anode shield that carries the anode. A plurality of brackets, preferably formed as a unitary structure with the anode shield, extend upwardly from the anode. The difflusion plate is connected to the plurality of brackets by a bayonet connection at each bracket. The diffusion plate is thus held elevated above the anode.

The reactor vessel configuration simplifies construction and assembly thereof. The anode assembly can easily be removed from the fluid delivery tube and the electrical conductor disconnected from the anode due to the bayonet connection between the delivery tube and the anode, and the tip/socket connection between the electrical conductor and the anode. A threaded connection between anode assembly and delivery tube is eliminated. Misadjustment of the anode assembly caused by the threaded connection between delivery tube and the anode assembly is eliminated. Assembly drawbacks associated with threaded connections such as damaged threads, and time consuming assembly/disassembly are reduced or avoided. The anode assembly need only be depressed, turned and withdrawn to be disengaged and removed from the reactor vessel.

The level adjustment of the anode can be accomplished entirely with access only on a top side of the reactor. No loosening operation or threaded adjustment on a bottom side of the reactor is required. The anode can be removed and installed from a top side of the reactor. The protruding tip and its associated flange can then be lifted up so that the spacer can be exchanged with a replacement spacer or spacers, for a more precise height or level adjustment.

By replacing the delivery tube having a threaded vertical adjustment at the vessel bottom wall with a fixed delivery tube having no relative movement between the vessel bottom wall and the tube, a reduced seal mechanism complexity is achieved for the delivery tube at the vessel bottom wall. The delivery tube can be permanently sealed to the vessel bottom wall without provision for relative vertical adjustment between the delivery tube and an anode post at the bottom wall.

A conductor wire sealed from the process fluid by a dielectric sleeve is used in combination with a dielectric material delivery tube resulting in an effective and more cost efficient construction. By separating the process fluid delivery function from the electrical conduction function, the need for a costly titanium delivery tube is eliminated.

The diffusion plate is more easily removed and reinstalled by virtue of the bayonet connections at each of the brackets of the anode shield. The small screws which were previously required to be removed with, for example, an Allen wrench, to remove the diffusion plate from the diffusion plate height adjusting mechanism, are eliminated. Additionally, the threaded height adjustment mechanisms are eliminated which could otherwise adversely vary the installed height or levelness of the diffusion plate.

A multi-function tool is also provided which functions to engage and install/remove the diffusion plate from the anode assembly, and also to engage and install/remove the anode assembly from the fluid delivery tube. The tool reduces or eliminates handling of the diffusion plate and the anode assembly during installation or removal which can cause anodic film damage, contamination and damage to the diffusion plate or anode assembly or the vessel interior.

An additional advantage of the bayonet connections of the diffusion plate and the anode in combination with the multi-function tool is the fact that a reduced overhead clearance is required to remove the diffusion plate and the anode. In comparison, to manually detach and remove, and later reinstall, the diffusion plate and anode of the reactor shown in FIG. 1, the entire head assembly including the lift and rotate mechanism which manipulates the rotor must be removed. After the reactor is reassembled and the head assembly is reinstalled, the wafer loading robot or manipulator (not shown) which loads wafers onto the rotor, must be reinstructed or recalibrated to ensure an accurate placement of wafers on the rotor. This step is time consuming and costly. Because the diffusion plate and anode assembly of the present invention can be manipulated and removed using simplified hand manipulations with the multi-function tool, it is possible that the lift and rotate mechanism can remain in place and only the rotor removed from the processing head to obtain enough access for diffusion plate and anode assembly removal and reinstallation. It is anticipated that this advantage of the invention will result in a reduced disassembly, inspection, and reassembly time during maintenance of the reactor vessel.

Numerous other advantages and features of the present invention will become readily apparent from the following detailed description of the invention and the embodiments thereof, from the claims and from the accompanying drawings in which details of the invention are fully and completely disclosed as part of this specification.

DETAILED DESCRIPTION OF THE INVENTION

Figure 1:
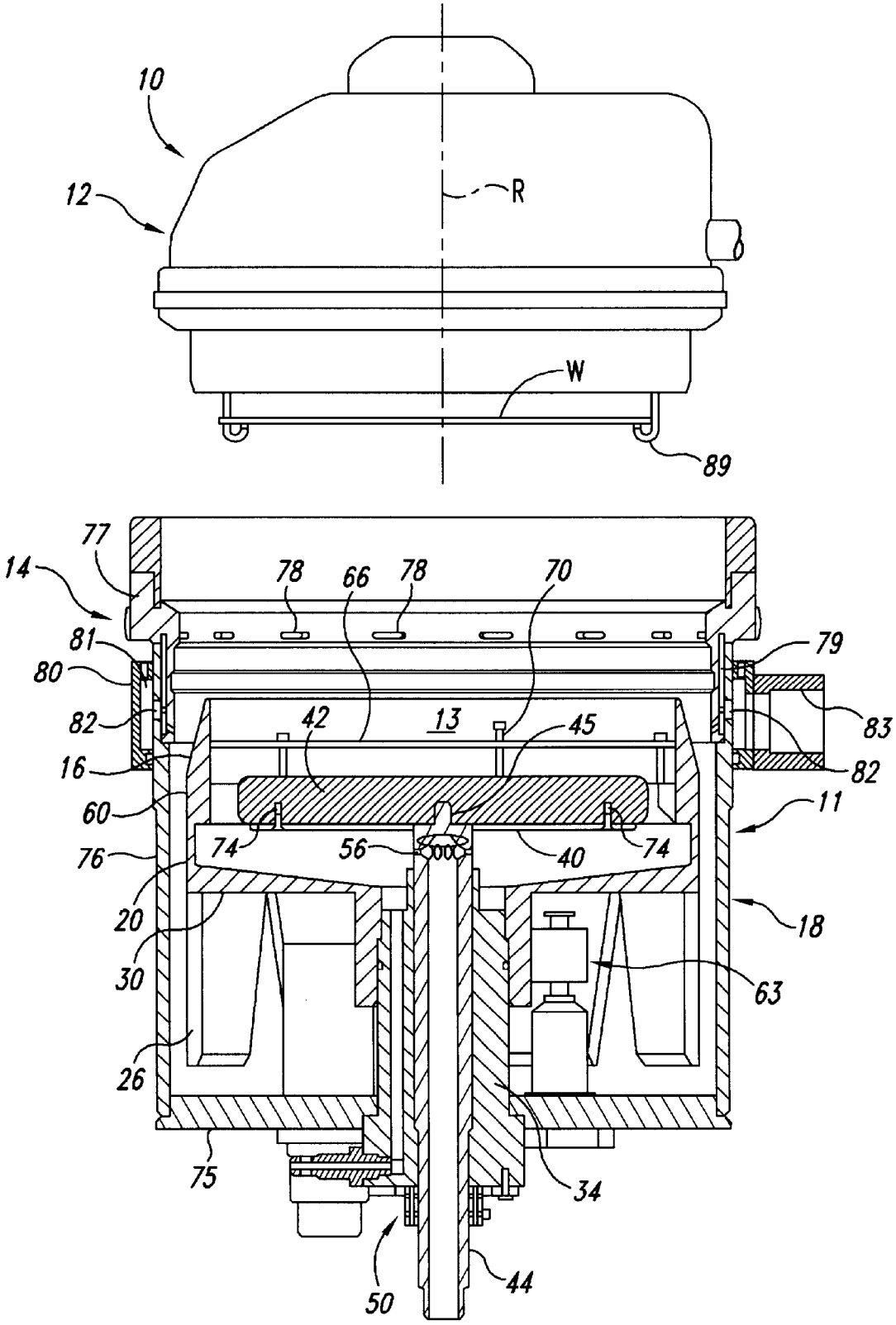
FIG. 1 is an exploded partially sectional view of a reactor vessel and processing head.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Figure 2:
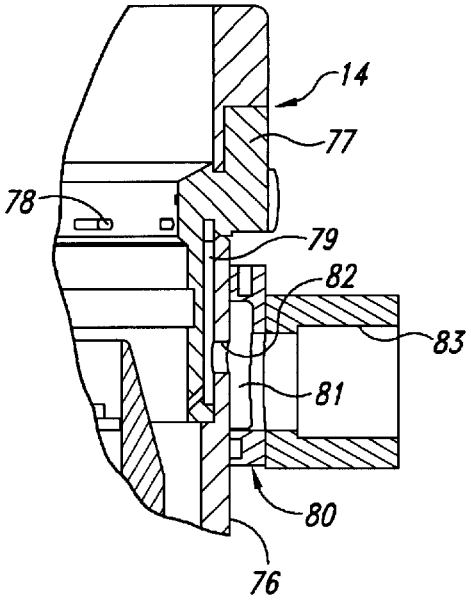
FIG. 2 is an enlarged fragmentary sectional view taken from FIG. 1.
Figure 3:
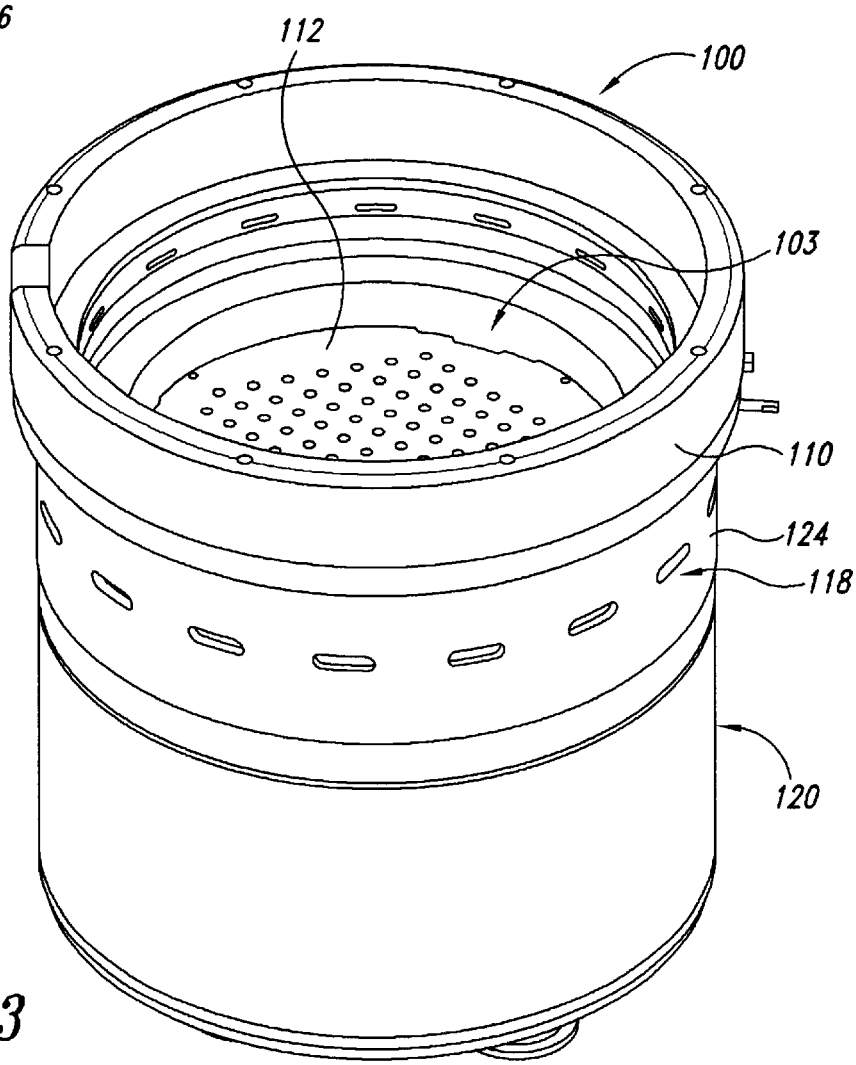
FIG. 3 is a perspective view of a reactor vessel constructed in accordance with one embodiment of the present invention.

FIGS. 3–6 illustrate a reactor vessel 100 which is to be used in cooperation with a processing head 12 (as shown in FIG. 1). The processing head 12 may, for example, be of the type disclosed in U.S. Ser. No. 08/988,333 filed Sep. 30, 1997, now U.S. Pat. No. 5,985,126 entitled: "Semiconductor Plating System Workpiece Support Having Workpiece—Engaging Electrodes With Distal Contact Part and Dielectric Cover" herein incorporated by reference. The processing head holds a wafer to be processed within a substantially closed processing volume 103 of the reactor vessel 100, and rotates the wafer during processing. The vessel 100 is shown without a vessel exhaust ring assembly for clarity to illustrate the underlying parts. It is to be understood that the outer vessel exhaust ring assembly 80 and exhaust nozzle 83 as shown for example in FIG. 1 would be mounted around the vessel 100 as shown for example in FIG. 2.

The reactor vessel 100 includes a rotor supporting ring or rim 110 mounted on an inner exhaust ring 124 which is carried on a reservoir container 120. A diffusion plate 112 is carried by an anode shield 116 which, in turn, carries an anode 114. The anode 114 is preferably a consumable anode composed of copper or other plating material. The anode 114 and the anode shield 116 are fastened together forming an anode assembly 117. A reactor cup assembly 118 is supported on, and partially held within, a reservoir container assembly 120. An anode electrical conductor assembly 122 extends vertically through the reservoir container 120 and makes electrical connection with the anode 114 as described below. A de-plating electrode 123 in the form of a ring 123*a* and a contact support 123*b* allows for periodic de-plating of wafer-engaging fingers 89 (shown in FIG. 1).

Figures 7, 7A:
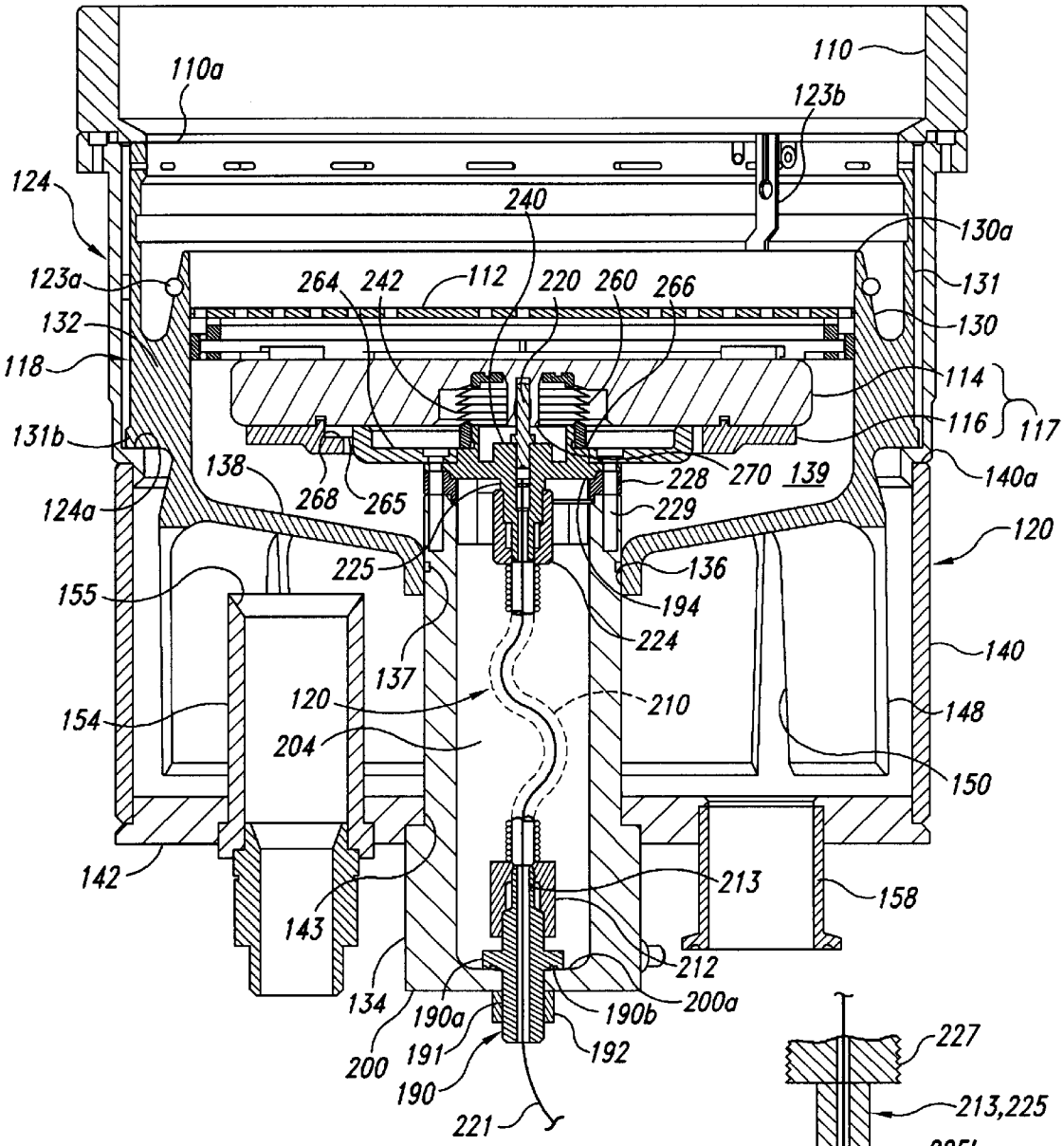
FIG. 7 is a sectional view taken generally along line 7—7 of FIG. 5.
FIG. 7A is an enlarged fragmentary sectional view from FIG. 7.
Figure 8:
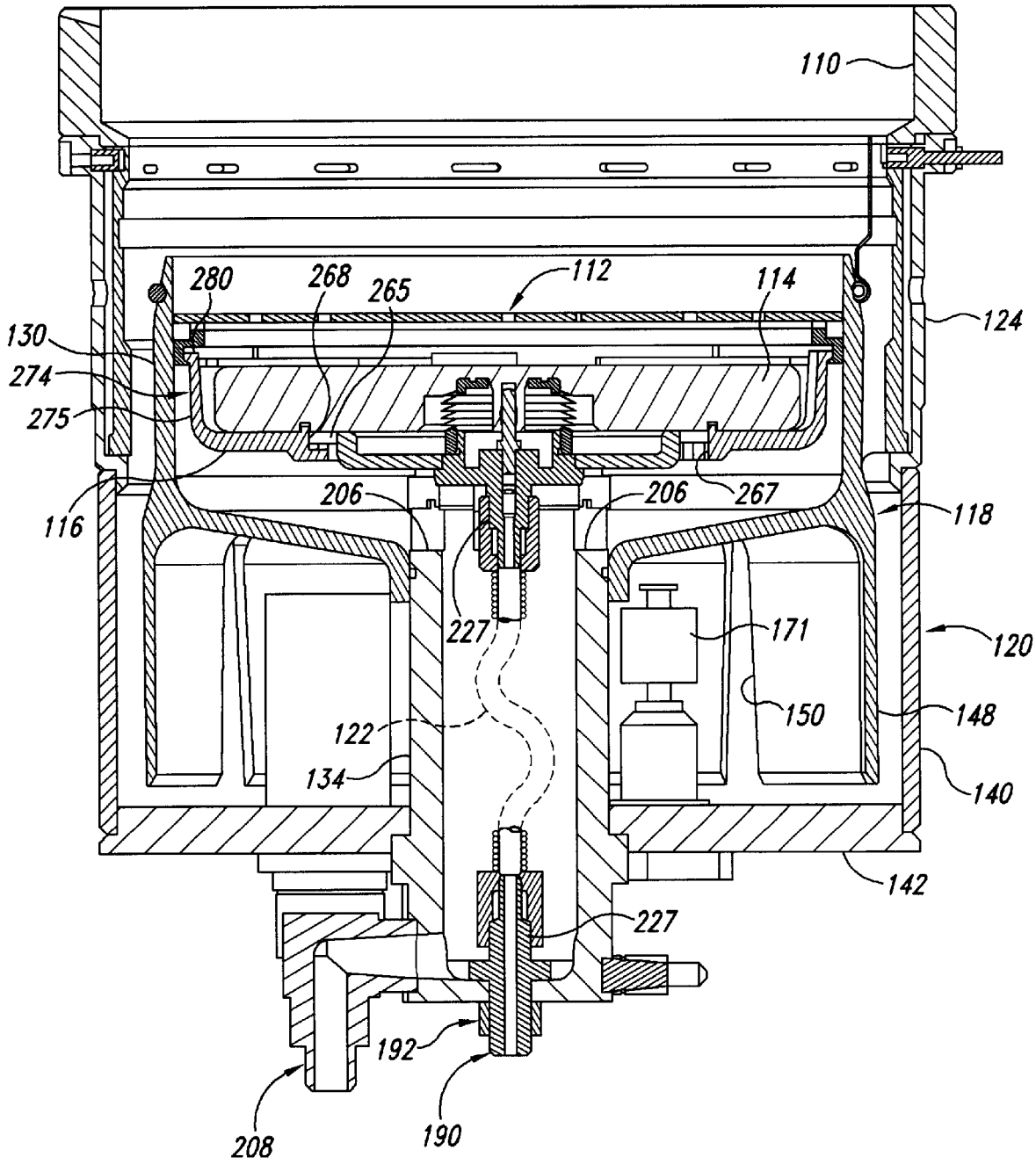
FIG. 8 is a sectional view taken generally along line 8—8 of FIG. 5.
Figure 9:
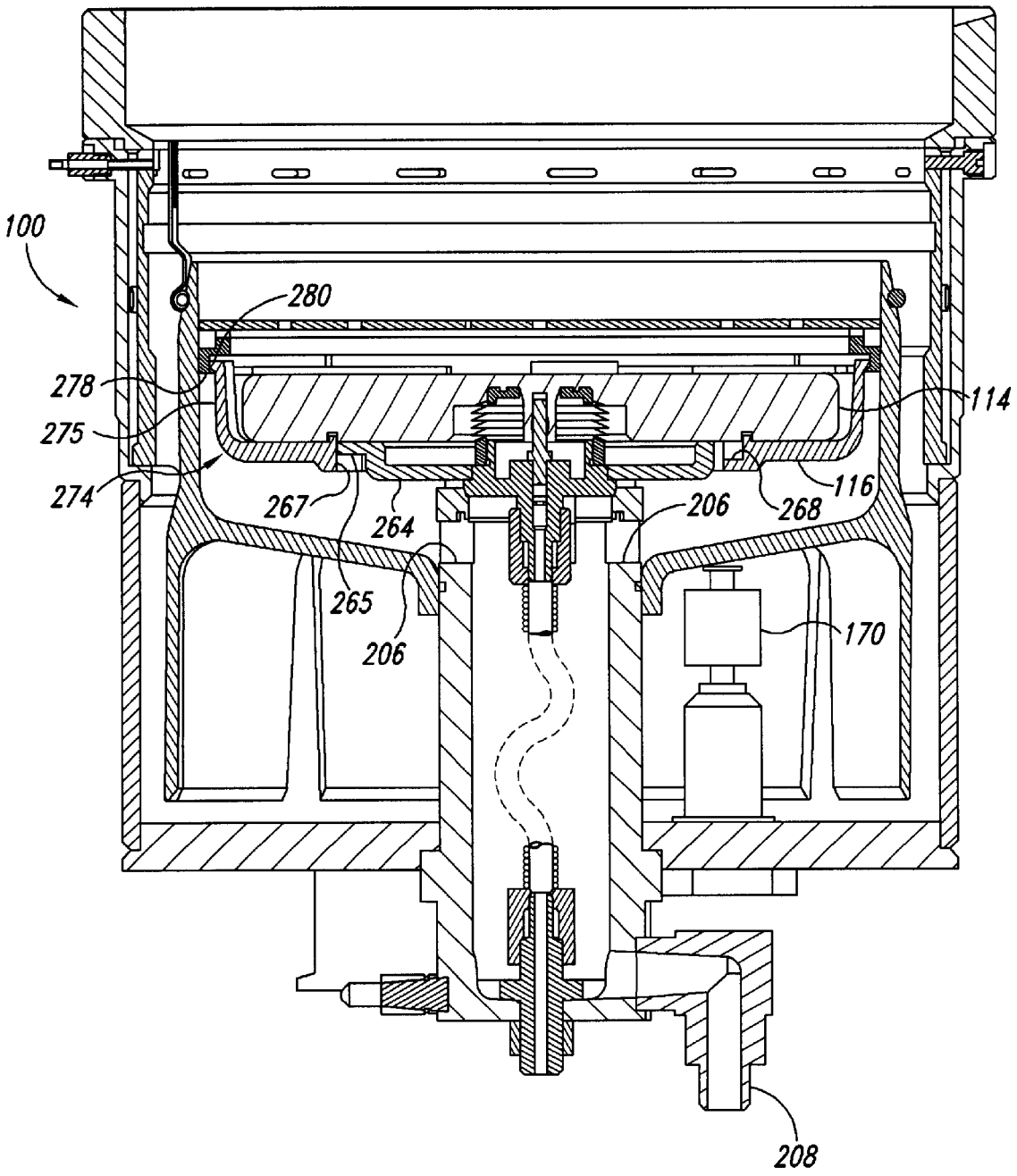
FIG. 9 is a sectional view taken generally along 9—9 of FIG. 5.

FIGS. 7–9 illustrate the rotor support ring 110 nesting into the exhaust ring 124 of the reservoir container assembly 120. The cup assembly 118 includes a cup inner sidewall 130 defining at its upper edge 130*a* an overflow weir, and a cup outer sidewall 131 which extends upward to a bottom 110*a* of the rotor support ring 110. The inner and outer sidewalls 130, 131 are radially connected by intermittent webs 132 formed integrally with the sidewalls 130, 131. A container or "cup" 139 for holding process fluid is formed by a cup bottom wall 138 and the inner sidewall 130.

The reservoir container assembly 120 includes a surrounding reservoir sidewall 140 that is sealed to a base plate 142 and supports the exhaust ring 124 at a top thereof. The cup assembly 118 is supported by an outer edge 131*b* of the outer sidewall 131 resting on a ledge 124*a* of the exhaust ring 124 which, in turn, is supported by a top edge 140*a* of the vessel sidewall 140. Thus the elevation and level of the cup assembly 118 is preferably fixed, i.e., it is non-adjustable with respect to the reservoir 120.

Figure 10:
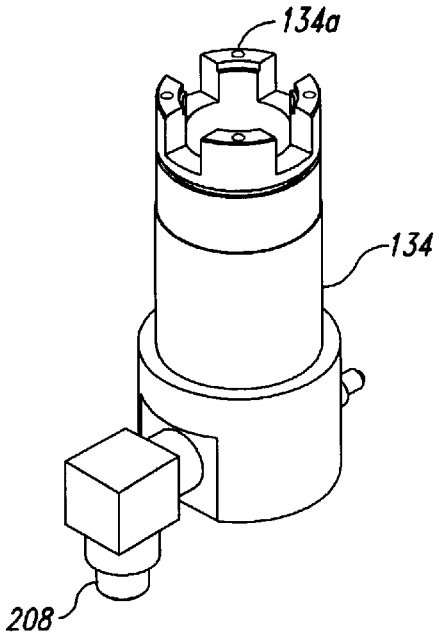
FIG. 10 is an enlarged perspective view of a fluid delivery tube shown in FIG. 7.

The anode 114 is connected by fasteners (as shown for example in FIG. 1) to the anode shield 116. The anode 114 is supported within the cup sidewall 130 by an anode support structure such as a fluid delivery tube or "anode post" 134. The anode post 134 is in the form of a cylindrical tube (see FIG. 10) having top and bottom ends substantially closed as described below. The anode post 134 extends through an opening 143 through the reservoir base plate 142 and through an opening 136 in the cup bottom wall 138. The anode post 134 is sealed to the cup bottom wall 138 around the opening 136 with an O-ring 137. Further, the anode post is sealed to the base plate 142 around the opening 143 by plastic welding or other sealing technique.

Extending downwardly from the cup sidewall 130 is a fluted skirt 148 having a plurality of slots 150 for allowing passage of process fluids. Through the base plate 142 of the reservoir container 120 passes an overflow standpipe 154 having an open end 155 for receiving process fluid. Also, connected to the bottom wall 142 is a process outlet 158 for the draining of process fluid from the reservoir container 120. It is to be understood that the standpipe 154 and the process outlet 158 would be connected to process piping to deliver process fluid to a recycling system or other process fluid system. In this regard, a precise control of the process fluid level in the container 120 can be maintained through use of a high process fluid level switch 170 and a low process fluid level switch 171 within the container 120 which open and close a control valve (not shown) connected to the outlet 158.

The anode electrical conductor assembly 122 includes at a bottom end thereof, a fitting 190 having a bottom region 191 threaded for receiving a nut 192. The fitting 190 can be firmly tightened to a bottom wall 200 of the anode post 134. The fitting 190 includes a top flange 190*a* with an O-ring seal element 190*b* which is drawn into sealing engagement with the top surface 200*a* of the wall 200 by advancement of the nut 192 on the fitting 190.

The anode post 134 includes an internal volume 204 in fluid communication with outlet openings 206 (shown in FIG. 8), and with a bottom supply nozzle 208 (shown in FIG. 8), for delivering process fluid into the cup 139, from an outside source of process fluid. The anode post 134 is closed at a top end by a top cap 194.

The anode electrical conductor assembly 122 includes a corrugated sleeve 210 sealed by a first coupling 212 to a neck 213 of the fitting 190. The sleeve surrounds a conductor wire 221 shown schematically as a line. The wire 221 is not shown in FIGS. 8 and 9 for clarity. The corrugated sleeve 210 extends upwardly and is sealed to a neck 225 of a fitting 195 of the top cap 194 by a second coupling 224.

FIG. 7A illustrates the sealing arrangement used at the couplings 212, 224. The necks 213, 225 receive a pre-flared, non-corrugated end 210*b* (or 210*c*) of the corrugated sleeve 210 which is then compressed by a tapered inside surface 225*a* of the respective coupling 212, 224, against a tapered outer surface 225*b* of the respective necks as the coupling threads 226 are advanced on respective fitting threads 227. This sealing arrangement is similar to commercially available flared fittings.

The top cap 194 includes a support ring 240. The support ring guides a conductor tip 220 held vertically within a central aperture of the support ring. The tip 220 is electrically connected to the conductor wire 221. The cap 194 further includes a surrounding guide ring 242 around which is carried a bellows seal 260 which extends upwardly from the cap 194. The bellows seal surrounds the tip 220 and, in its relaxed state, extends to a position upwardly thereof. The bellows seal 260 includes a top opening 262 in registry with the tip 220, and a surrounding groove 260*c* for holding an O-ring seal element 260*b* (see FIGS. 11–13).

Figure 11:
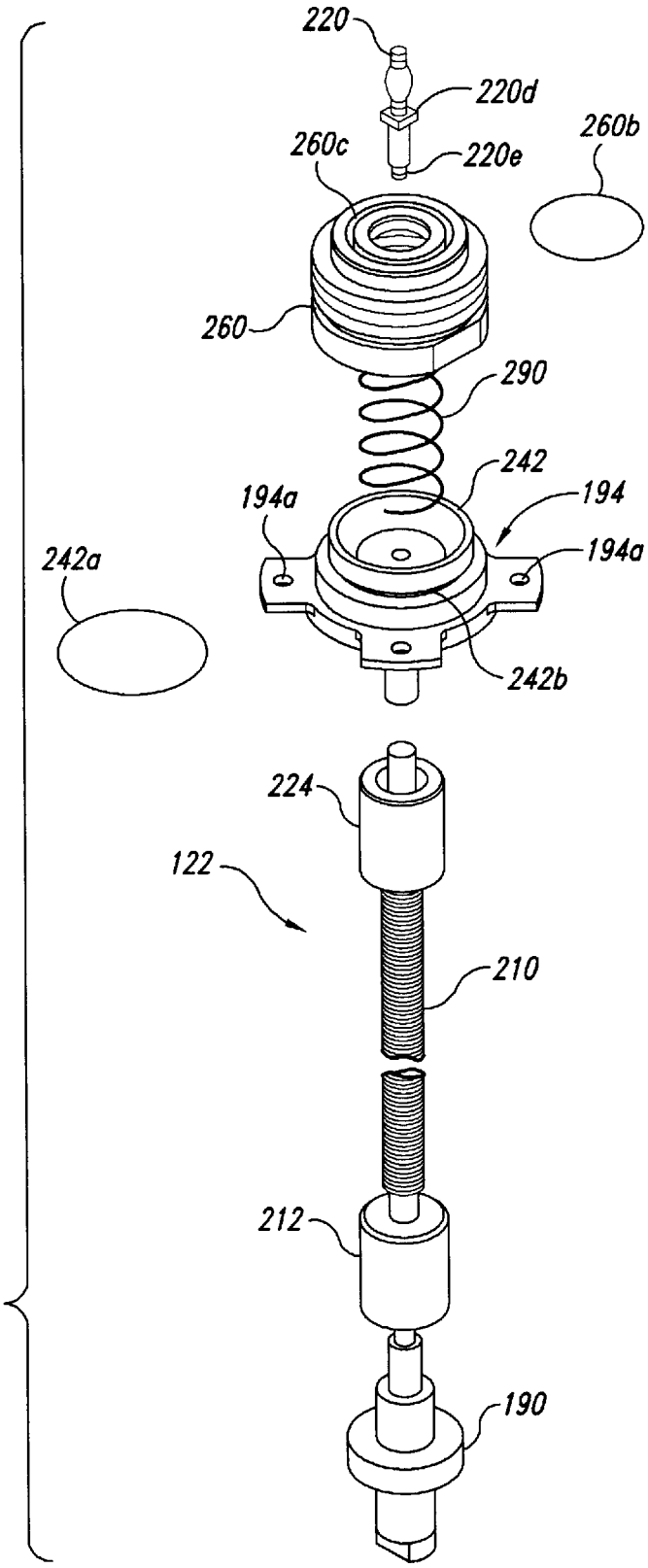
FIG. 11 is an exploded perspective view of one embodiment of an anode conductor assembly.

The top cap 194 is substantially cross-shaped in plan view, having a plurality of fastener holes 194*a* (see FIG. 11). A substantially circular, dished attachment plate 264 is arranged coaxially with the top cap 194 and includes a central aperture 266 for receiving the guide ring 242 of the top cap 194. The attachment plate 264, and the cap 194 are fastened together and to the post 134, via an interposed spacer 228, by four fasteners 229. The fasteners are fit into four holes 264*a* through the attachment plate 264 (shown in FIG. 4), the four fastener holes 194*a* through the top cap 194, four holes 228*a* through the spacer (shown in FIG. 4), and then threaded into four threaded holes 134*a* of the anode post (shown in FIG. 10). The spacer 228 is selected for a precise thickness to set the elevation of the anode 114 with respect to the cup assembly 118, particularly with respect to the top edge 130*a* of the sidewall 130.

Figure 17:
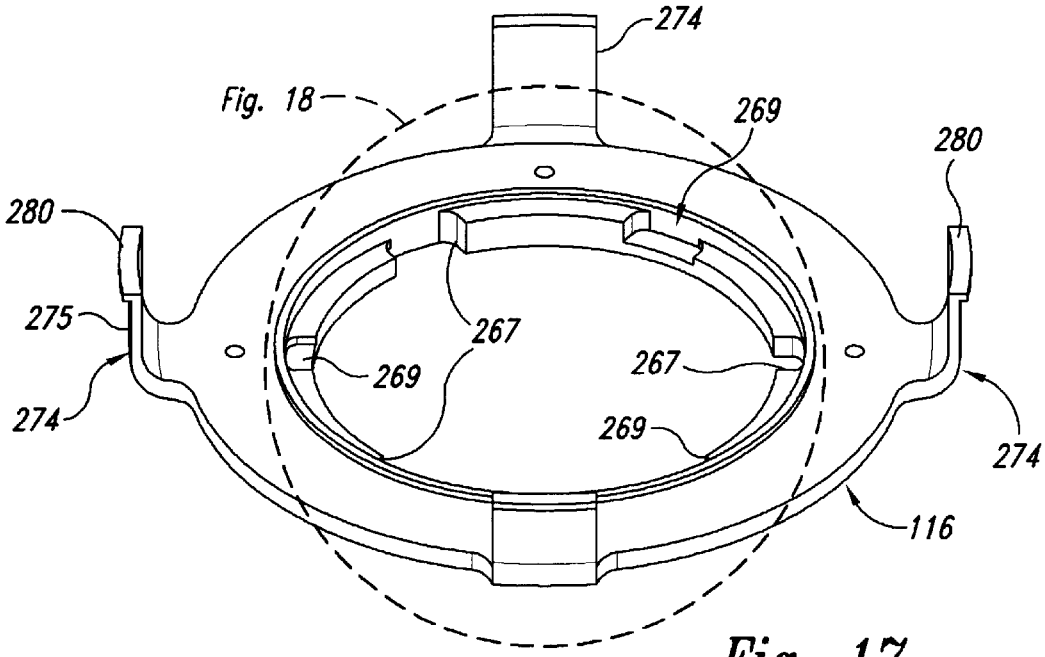
FIG. 17 is a perspective view of one embodiment of an anode shield as used in the reactor vessel of FIG. 3.
Figure 18:
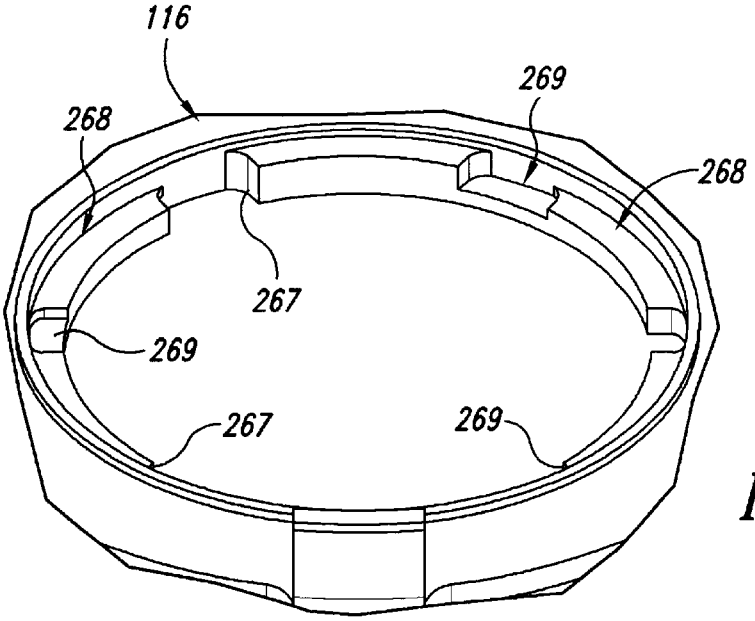
FIG. 18 is a fragmentary, enlarged perspective view of the anode shield of FIG. 17.

The attachment plate 264 is connected to the anode assembly by a bayonet connection. A bayonet connection is characterized as one in which one part is connected to another part by first a movement toward each other and then a second relative rotational movement between the parts. The attachment plate 264 includes a plurality of spaced apart, radially extending tabs 265. During installation of the anode assembly, the tabs 265 vertically enter vertical slots 267 (see FIGS. 9, 17 and 18) formed in the anode shield 116, and upon turning of the anode assembly 117 from above, the tabs 265 are advanced relatively in circular, substantially horizontal slots 268 formed between the anode 114 and the shield 116. The horizontal slots 268 each terminate in a tab-receiving recess 269 which restrains the tabs from rotational disengagement once completely installed. Spring force from a bellows spring (described below) holds the tabs 265 within the recesses 269. During engagement of the tabs 265, the bellows 260 and bellows spring are vertically compressed as the tip 220 is plugged into a socket 270 formed in the anode 114 to make a solid "plug-in" or "plug-and-socket" electrical connection thereto.

To disengage the anode assembly from the attachment plate 264, the anode is pressed downwardly to elevate and disengage the tabs 265 from the recesses 269, and the anode is turned or rotated to align the tabs with the vertical slots 267. The anode assembly can then be withdrawn upwardly. The tip 220 will be pulled free from the socket 270 and resiliently open up once free of the socket.

Figure 4:
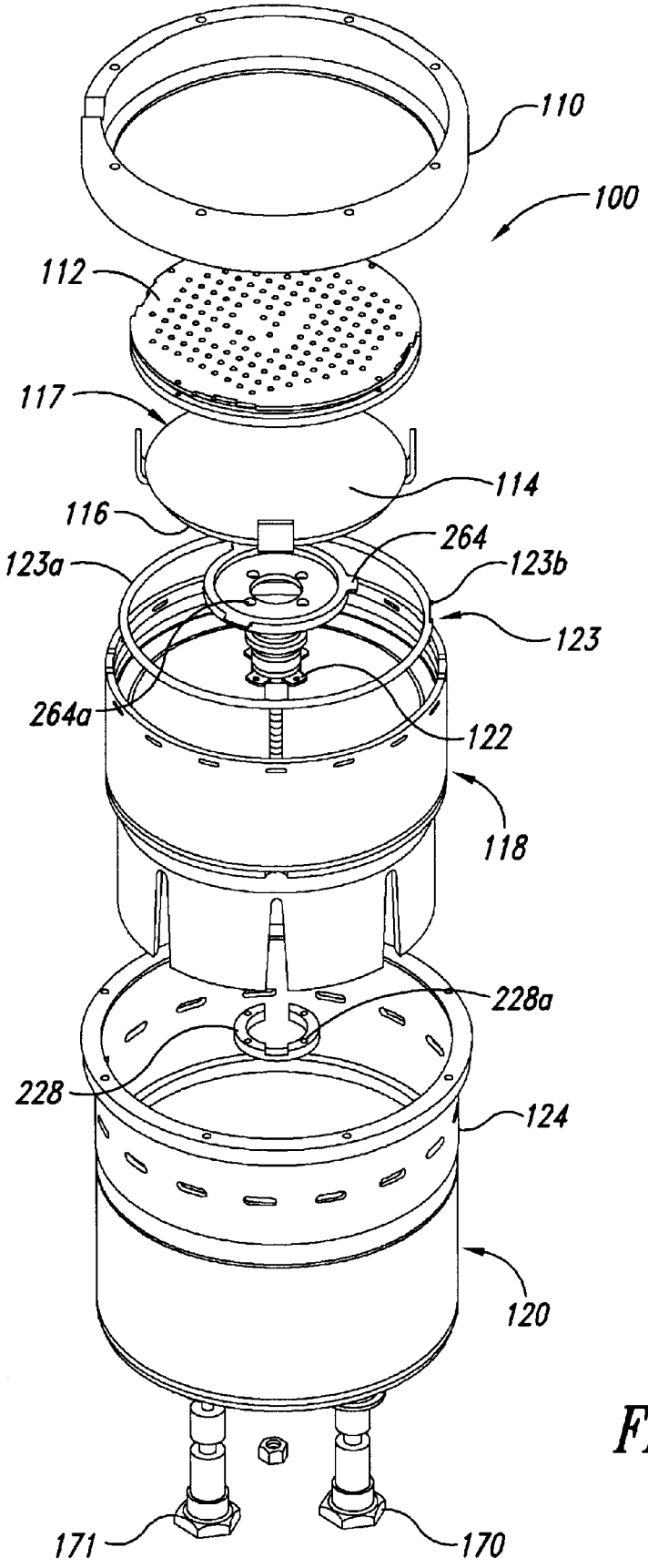
FIG. 4 is an exploded perspective view of the reactor vessel of FIG. 3.

It can be observed that the height adjustment of the anode can be set entirely from above. First, the anode 114 and shield 116 are removed from the attachment plate 264. Second, the attachment plate is removed from the post 134 by removal of the fasteners 229. Third, the cap 194 is lifted upwardly, and the spacer 228 is replaced with a spacer having a desired thickness dimension. As shown in FIG. 4 the spacer 228 is C-shaped to facilitate replacement around the conductor assembly 122 without complete disassembly thereof, i.e., there is no need to remove the tip 220 or the top cap 194 from the conductor wire.

Figure 21:
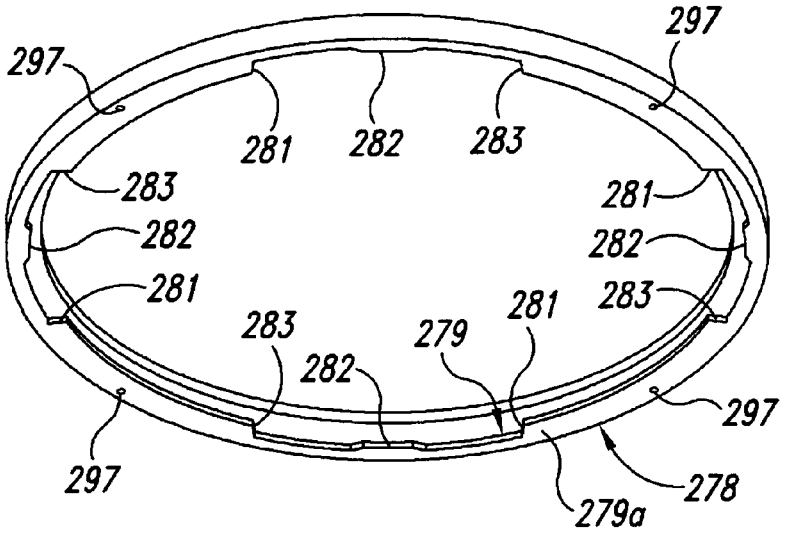
FIG. 21 is a bottom perspective view of one embodiment of a bottom ring portion of the diffusion plate of FIG. 19.

As illustrated particularly in FIGS. 8 and 9, the diffusion plate 112 is connected to intermittently arranged upstanding bracket members 274 using bayonet connections. As shown in FIGS. 9 and 21, a connector ring 278 of the diffusion plate 112 has a C-shaped cross-section forming a channel 279. Each bracket 274 includes a vertical leg 275 and a radially, outwardly extending tab member 280. During installation, each tab member 280 enters a wide slot or recess 281 through the bottom leg 279*a* of the C-shaped cross-section. Upon relative turning between the ring 278 and the bracket 274, each vertical leg 275 of each bracket 274 resiliently passes a detent 282 and enters a more narrow slot or recess 283. Each detent 282 thus resiliently locks a bracket member 274 to the connector ring 278. To remove the diffusion plate 112 from the anode assembly 117, the plate is rotated in an opposite direction. The legs 275 resiliently deflect radially inwardly a sufficient amount to pass the detents 282. Finally, the tab members 280 are withdrawn through the recesses 281.

Figure 12:
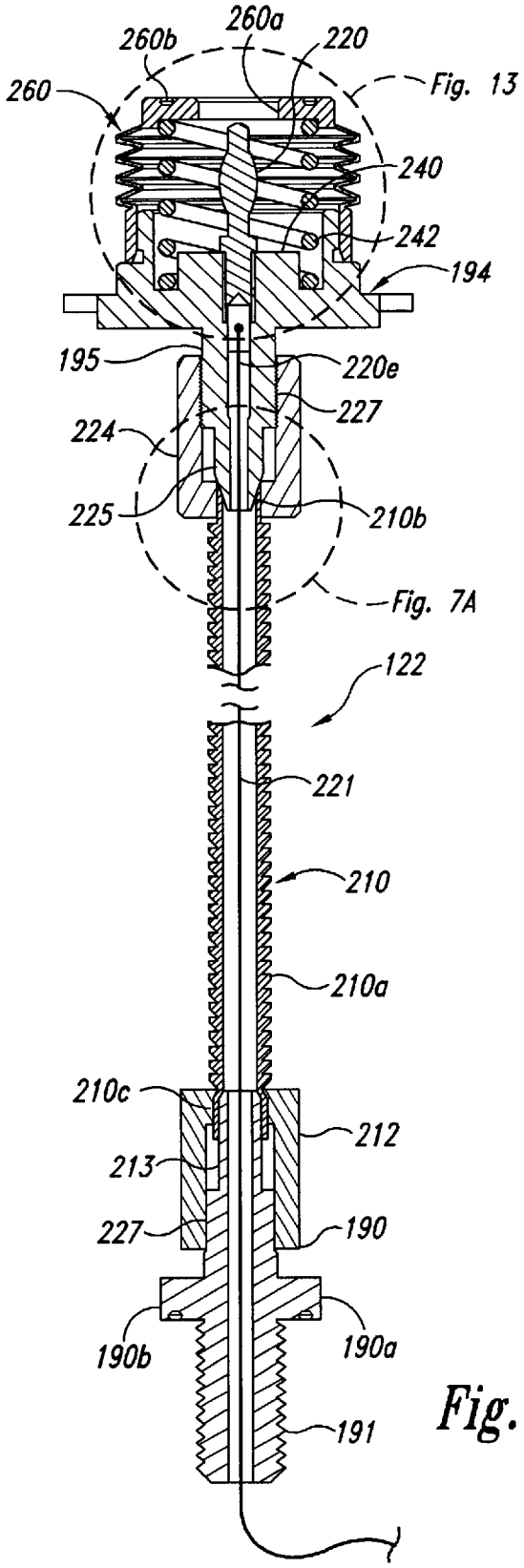
FIG. 12 is a sectional view of the anode conductor assembly of FIG. 11.
Figure 13:
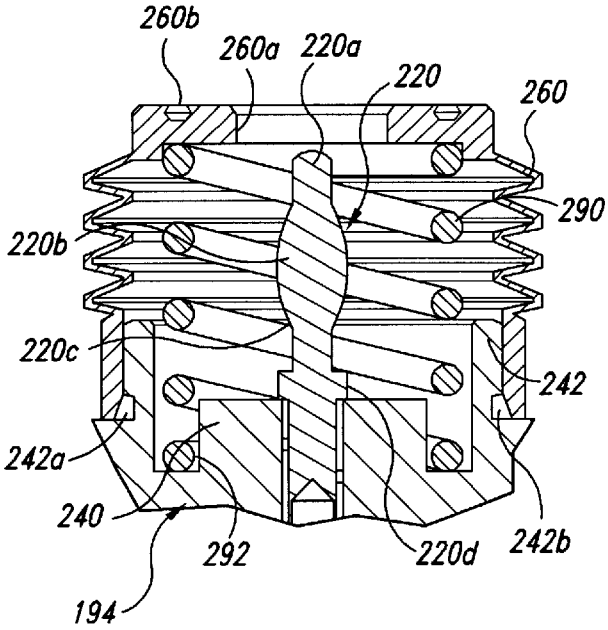
FIG. 13 is an enlarged fragmentary sectional view of the anode conductor assembly of FIG. 12.

FIGS. 11–13 illustrate the construction of one embodiment of the anode conductor assembly in more detail. As illustrated, the anode tip 220 has a profile which compresses when installed in the socket 270 of the anode. The tip includes a small diameter distal end region 220*a*, a wide central region 220*b*, and a narrow base region 220*c*. The base region 220*c* terminates at a flange or stop 220*d* which sets the extension of the tip 220 from the support ring 240 of the cap 194.

The tip 220 includes a soldering connection or crimping region 220*e* at a bottom end thereof that is used for connecting it to the conductor wire 221 (shown schematically in FIG. 12). The conductor wire 221 extends downwardly from the tip 220 through the fitting 195 of the cap 194, the corrugated sleeve 210, and the bottom fitting 190. From the bottom fitting 190, the wire 221 extends externally of the reactor vessel 100 for connection to a plating power supply.

The corrugated sleeve 210 includes a corrugated length 21*a* between the couplings 212, 224 and a first non-corrugated portion 210*b* which over-fits the neck 225 of the fitting 195, and a second non-corrugated portion 210*c* which over-fits the neck 213 of the fitting 190 as illustrated in FIG. 7A. The couplings 212, 224, by progressive threaded tightening onto the respective necks 213, 225, seal the non-corrugated regions 210*b*, 210*c* onto the fittings 190, 195 to form a sealed configuration around the conductor wire within the anode post 134.

FIG. 11 illustrates the assembly of the conductor assembly 122, absent the wire conductor for clarity. The O-ring 260*b* is arranged to fit within a channel 260*c* of the bellows 260. Another O-ring 242*a* is arranged to fit within a channel 242*b* (see FIG. 13) of the guide ring 242 to seal the bellows 260 to the top cap 194.

As illustrated in FIG. 13, a bellows coil spring 290 is fit within the bellows 260 and the top cap 194. The spring 290 is fit within an annular channel 292 formed between the guide ring 242 and the support ring 240. The spring 290 urges the anode assembly away from the attachment plate 264 to resiliently seat the tabs 265 in the tab-receiving recesses 269. Additionally, the spring acts to press the O-ring 260*b* into the anode to effect a tight seal thereto.

Figure 14:
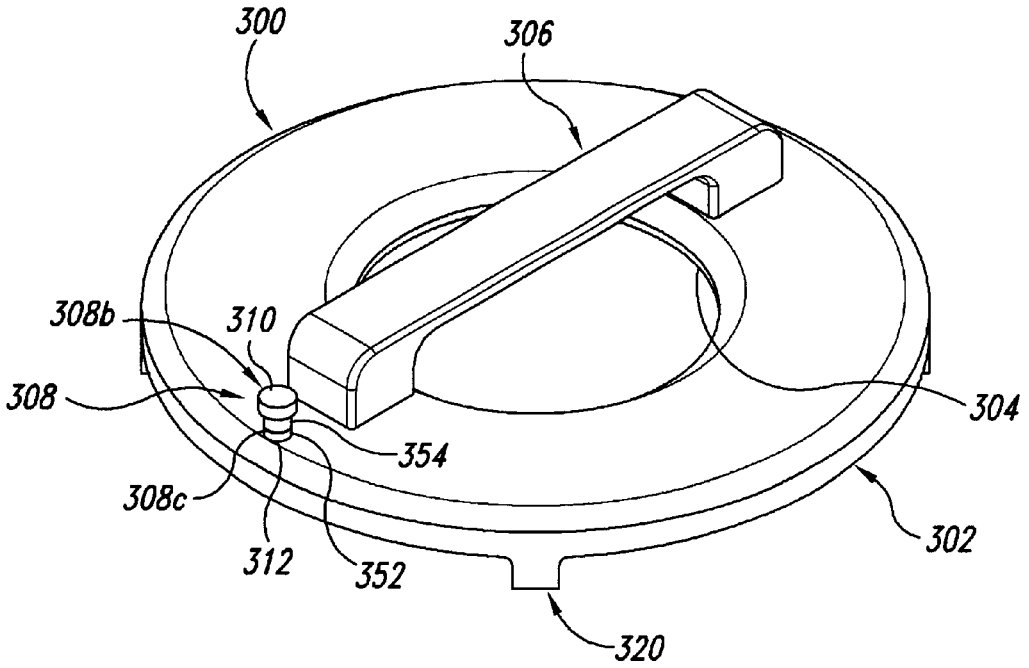
FIG. 14 is a top perspective view of a diffusion plate and anode removal/installation tool constructed in accordance with one embodiment of the present invention.

FIG. 14 illustrates a multi-function diffusion plate and anode removal/installation tool 300 of the present invention. The tool 300 includes a disc structure 302 having a central hole 304. Bridging across the central hole is a handle 306. The handle is held to the disc structure by fasteners 307 (shown in FIG. 15). A lock pin 308 having a grip head 310 penetrates a pin receiving hole 312 through the disc structure 302.

Figure 5:
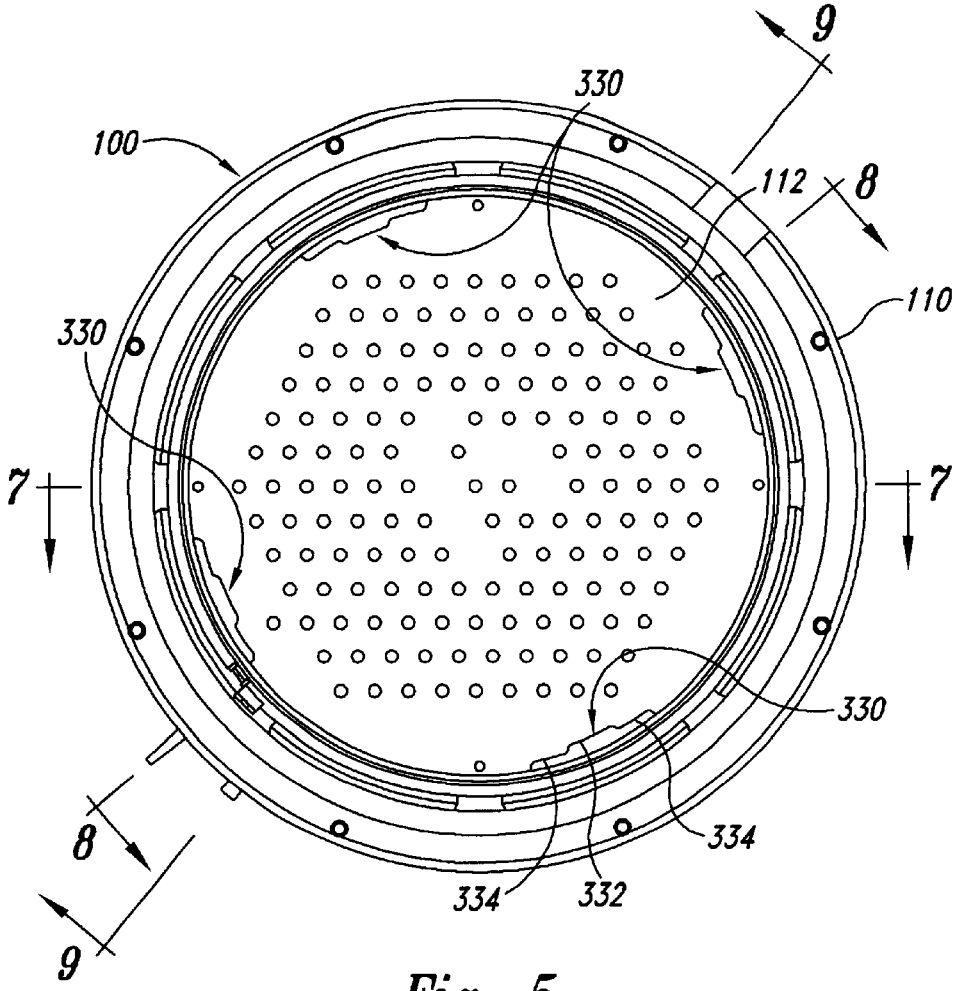
FIG. 5 is a top view of the reactor vessel of FIG. 3.
Figure 6:
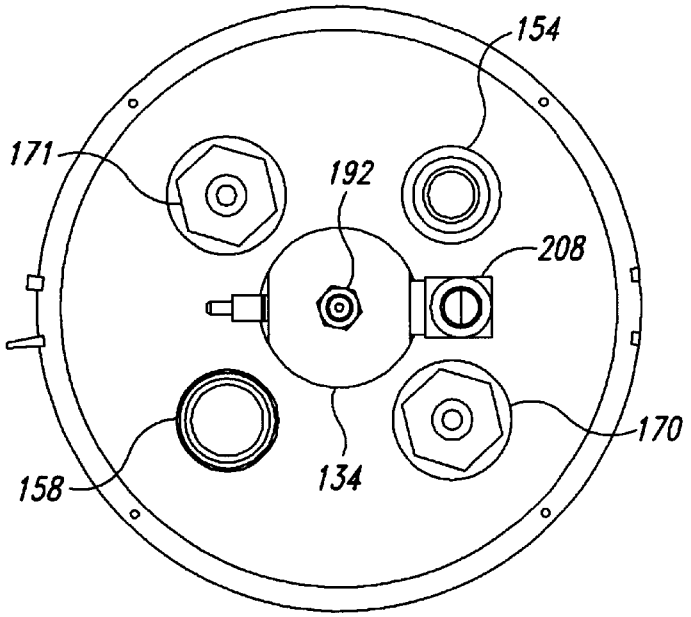
FIG. 6 is a bottom view of the reactor vessel of FIG. 3.
Figure 15:
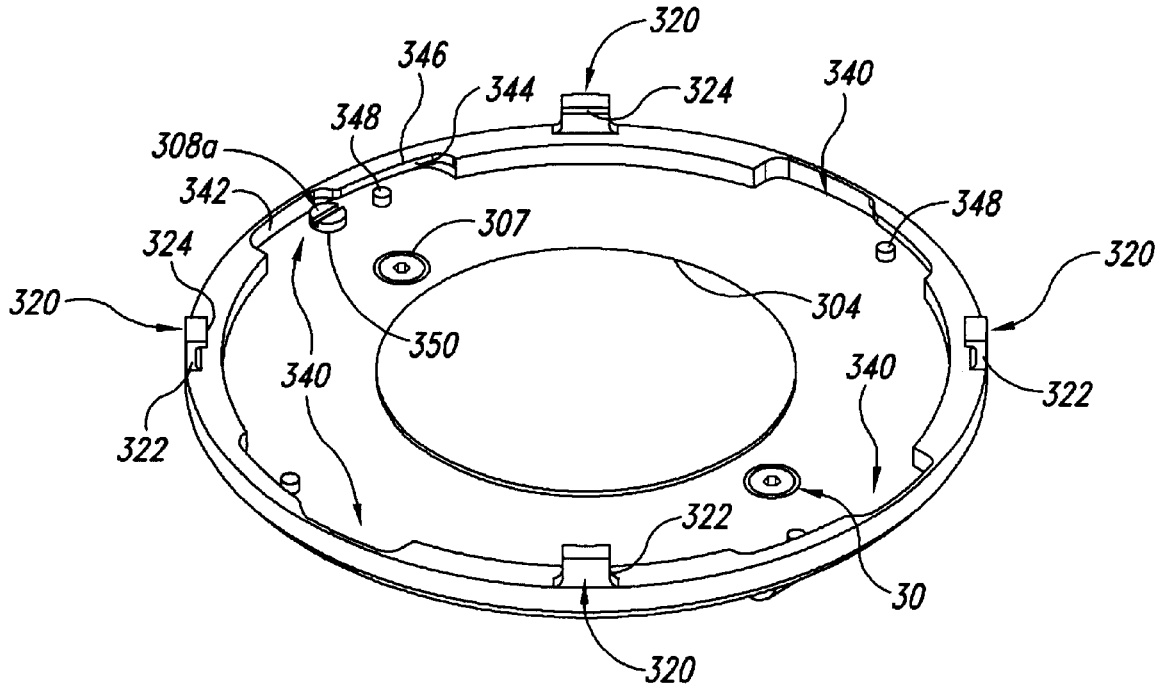
FIG. 15 is a bottom perspective view of the tool of FIG. 14.
Figure 19:
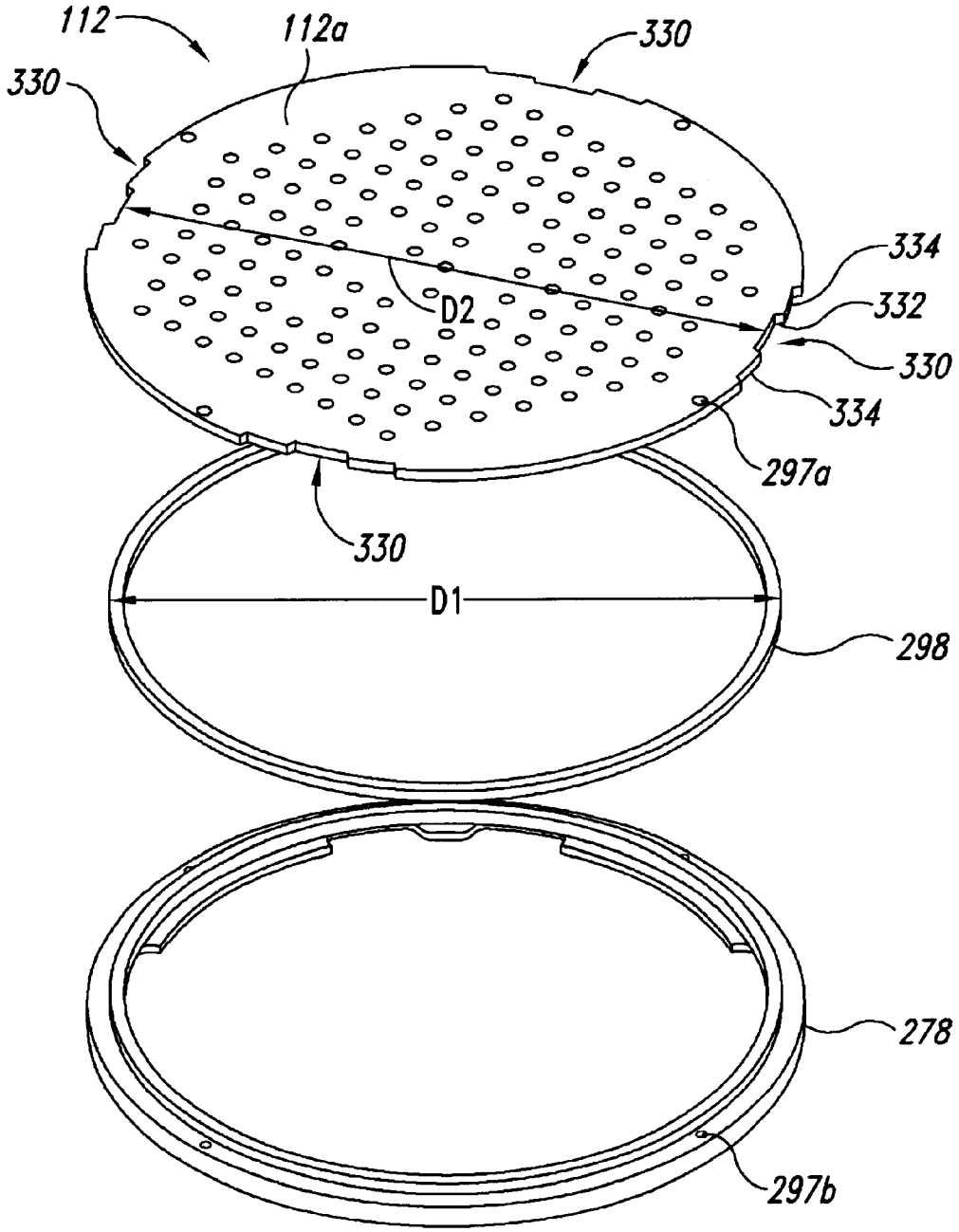
FIG. 19 is an exploded perspective view of one embodiment of a diffusion plate as used in the reactor vessel of FIG. 3.
Figure 20:
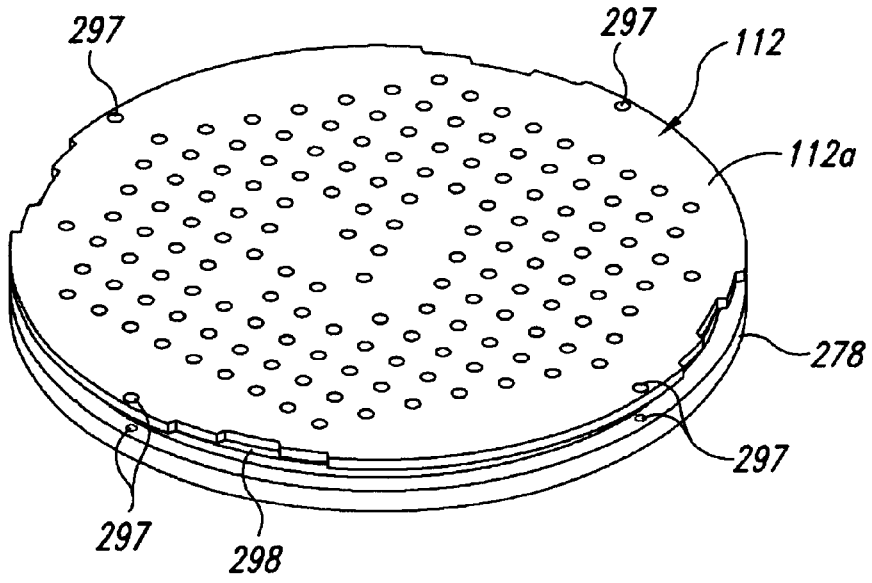
FIG. 20 is a perspective view of the diffusion plate of FIG. 19.

As illustrated in FIG. 15, the disc structure includes four L-shaped hook arms 320, each having a vertical leg 322 and a radially inwardly directed detent or hook portion 324. In operation, the hook arms 320 extend downwardly. The hook arms 320 are configured and arranged to engage bayonet recesses 330 formed through an outside of a top perforated plate 112*a* of the diffusion plate 112 as illustrated in FIGS. 5, 19 and 20. Each recess 330 includes a wide region 332 for receiving a hook portion 324, and two narrow regions 334 for snugly receiving a leg 322 into a locked position (in either direction depending on whether removal or installation is taking place). When the leg 322 moves in this position, the hook portion 324 is located below the top perforated plate 112*a*. The tool with engaged diffusion plate can then be rotated in one direction to remove the diffusion plate 112, or rotate in an opposite direction to install the diffusion plate 112 from or onto the brackets 274.

The tool 300 also serves as an anode assembly removal/installation tool once the diffusion plate 112 has been removed. On a bottom surface of the tool 300 are located four bracket/engaging recesses 340 that are spaced apart to mate with the brackets 274 of the anode shield 116. Each recess 340 includes a recess region 342 for receiving the radially turned end of the bracket 274 therethrough. A further recess region 344 is defined at least in part, by a radially extending ledge 346. Extending vertically from the disc structure 302 are four guide pins 348. Each guide pin 348 is radially spaced from a respective ledge 346 by a distance approximately equal to, or greater than, a radial thickness of a respective bracket vertical leg 275. Thus, in operation, the tool 300 is placed onto the anode assembly 117 with each bracket 274 received into one of the wide recess regions 342. The tab member 280 of each bracket 274 is located above a respective ledge 346. The tool is then rotated relative to the anode such that the vertical leg 275 of each bracket 274 slides circumferentially between a respective ledge 346 and a respective guide pin 348. The tab member 280 of each bracket 274 is thus captured above the respective ledge 346.

The lock pin 308 is operated by force of gravity to fall to a position behind one of the brackets 274 which has passed into the narrow recess region 344. The lock pin 308 thus prevents inadvertent reverse rotation of the tool relative to the anode. This prevents accidental separation of the tool and the relatively heavy anode assembly during removal, assembly or transporting of the anode assembly. The lock pin 308 is preferably formed of two pieces: a bottom piece 308*a*, having a tool engageable head 350 connected to a first barrel 352, and a top piece 308*b* which includes the gripping head 310 connected to a second barrel 354. The first barrel has a male threaded extension (not shown) which is engaged by a female threaded socket (not shown) of the second barrel. Thus relative rotation of the first and second barrels can separate or join the two pieces 308*a*, 308*b* at a seam 308*c* for disassembly or assembly of the pin 308. The gripping head 310 and the engageable head 350 allow retention of the pin to the interposed disc structure 302, while still allowing vertical reciprocation with respect thereto.

Figure 16:
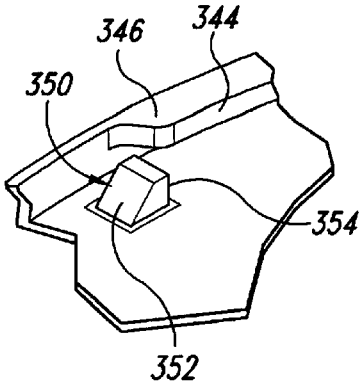
FIG. 16 is a fragmentary bottom perspective view of an alternate lock pin arrangement for the tool in FIG. 14.

Additionally, as illustrated in FIG. 16, the lock pin can alternately be configured to allow lifting of the lock pin by sliding pressure (rather than manual lifting) of the respective bracket 274 during engagement of the tool to the anode assembly. The pin is designed to be lifted by the top surface of the tab 274 as it enters the slot 342 and then falls into position upon rotation of the handle. The lock pin however can require manual lifting of the pin to disengage the tool from the anode assembly, by relative rotation therebetween. This is accomplished, for example, by a ratchet tooth shaped pin 350, wherein the ratchet tooth shaped pin would provide a slanted surface 352 facing an engagement direction with the bracket 274. The pin 350 includes a vertical surface 354 facing a tool disengagement direction. A retaining mechanism such as a detent (not shown) or a two piece construction with enlarged heads (such as described with regard to the pin 308) can be provided on the shaped pin to prevent separating of the shaped pin from the interposed disc structure 302. The retaining mechanism would allow vertical reciprocation of the pin with respect to the disc structure.

The tool 300 thus provides an effective means to disassemble and reassemble the diffusion plate and anode assembly from the vessel. The tool also reduces contact, damage and contamination of the anode and anode film.

FIGS. 19–20 illustrate the diffusion plate 112 in detail. The diffusion plate includes the top perforated plate 112*a* which is attached by fasteners (not shown) through four fastener hole pairs 297*a*, 297*b* to the connector ring 278, capturing a spacer ring 298 therebetween. The holes 297*b* are threaded to engage the fasteners. The spacer ring 298 has a smaller outside diameter D1 than an inside diameter D2 between diametrically opposing wide recesses 332 to ensure noninterference of the spacer ring 298 with the hook arms 320 of the tool 300 during installation or removal of the diffusion plate. The thickness of the spacer ring 298 provides a vertical space below the perforated plate 112*a*, particularly below the bayonet recesses 330, for the hook portion 324 to be received.

In the disclosed embodiment, the cup assembly 118, the anode post 134, the reservoir container 120, the anode shield 116, the difflusion plate 112, the exhaust ring 124, the rotor support ring 110, the corrugated sleeve 210, the spacer 228, the fasteners 229, the top cap 194, the fitting 190, the nut 192, the couplings 212, 224, and the attachment plate 264, are all preferably composed of dielectric materials such as natural polypropylene or polyvinylidene fluoride. The conductor wire 221 is preferably composed of copper or another appropriate conductor, as is the tip which also can be gold plated for enhanced electrical contact. The bellows seal 260 is preferably composed of a Teflon material. The bellows spring is preferably composed of stainless steel. The various O-rings are preferably composed of an acid compatible fluoro-elastomer, depending on the process fluid.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

What is claimed is:

1. A reactor for electroplating a microelectronic workpiece, comprising:

a vessel;

a cup for holding a supply of process fluid, said cup held within said vessel;

an anode located within said cup and having a top surface and a bottom surface;

a conductor electrically connected to said bottom surface of said anode by a plug-in connection;

an anode support mechanically connected to said anode by a connection adapted to be positioned into a fully engaged condition from a fully disengaged condition by relative axial motion and rotation of the anode support and the anode of less than 360 degrees to engage interengaging portions of said anode support with interenoaging portions of said anode; and said conductor extending downwardly through said vessel and exposed outside said vessel for electrical connection thereto.

2. The reactor according to claim 1, further comprising a diffusion plate and an anode shield, said anode shield arranged against said bottom surface of said anode and having brackets extending above said top surface of said anode, and said diffusion plate carried on said brackets, spaced at a distance above said top surface of said anode.

3. The reactor according to claim 2 wherein said diffusion plate and said brackets include interengaging parts which form at least one bayonet connection.

4. The reactor according to claim 2, wherein said brackets are formed in unitary fashion with said anode shield, and extend perpendicularly therefrom, and each of said brackets has a tab member, and said diffusion plate includes a plurality of horizontal slots, and each tab member is received in one of said horizontal slots.

5. The reactor according to claim 1 further comprising a tool having a handle, said tool and said diffusion plate having interengaging portions which together define a bayonet connection, said tool and said diffusion plate lockable together by vertical mating and then relative rotation.

6. The reactor according to claim 5 wherein said tool and said anode carry interengaging portions which together define a bayonet connection, said tool and said anode lockable together by vertical mating and then relative rotation.

7. A reactor according to claim 1, wherein said anode support comprises an anode post surrounding said conductor, said cup having an opening in a bottom wall thereof for receiving the anode post, said anode post having a fluid inlet which is connectable outside said vessel, and a fluid outlet which is exposed within said cup, and a fluid path between said inlet and said outlet.

8. A reactor according to claim 1, wherein said anode support comprises a tube, and said mechanical connection includes radially extending tabs carried by said tube which engage horizontal slots carried by said anode.

9. The reactor according to claim 1 further comprising a tool having a handle, said tool and said anode carrying interengaging portions which together define a bayonet connection, said tool and said anode lockable together by vertical mating and then relative rotation.

10. The reactor according to claim 1, further comprising a diffusion plate and an anode shield, said anode shield arranged against said bottom surface of said anode and having brackets extending above said top surface of said anode, and said diffusion plate carried on said brackets, spaced at a distance above said top surface of said anode, wherein said diffusion plate and said brackets include interengaging parts which are alternately engaged and disengaged by relative turning between the anode and the diffusion plate.

11. The reactor according to claim 8, further comprising a tool, said tool and said diffusion plate having interengaging portions, said tool and said diffusion plate lockable together for conjoint turning movement.

12. The reactor according to claim 10, further comprising a tool having a handle, said tool and said diffusion plate having interengaging portions which together define a bayonet connection, said tool and said diffusion plate lockable together by vertical mating and then relative rotation.

13. The reactor according to claim 12 wherein said tool and said anode carry interengaging portions which together define a bayonet connection, said tool and said anode lockable together by vertical mating and then relative rotation.

14. The reactor according to claim 1 further comprising a tool having a handle, said tool and said anode carrying interengaging portions which together define a connection which can be engaged and alternately disengaged by relative rotation between the tool and said anode.

15. The reactor of claim 1 wherein the anode includes an electrically conductive portion and a shield portion, and further wherein the anode support is mechanically connected to the shield portion, the anode support and the shield portion being movable relative to each other between the engaged condition and the disengaged condition by relative rotation of less than 360 degrees.

16. A method of assembling a reactor vessel having a reservoir container with an open top and a cup supported within the container and accessible through the open top, and an anode support accessible through the open top, comprising the steps of:

providing an anode;

providing that said anode and said anode support include therebetween engageable parts which define a bayonet connection;

lowering said anode through the open top and engaging said parts in a vertical direction; and turning said anode with respect to said anode support to fully engage said parts.

17. The method according to claim 16 comprising the further steps of:

providing a tool which engages and holds said anode and which includes a handle;

engaging said tool to said anode and holding said anode with said tool;

and said steps of lowering and turning said anode are undertaken by force exerted on said anode by said tool; and disengaging said tool from said anode.

18. The method according to claim 17 wherein said step of engaging said tool to said anode is further defined in that said tool and said anode include therebetween interacting portions which together define a bayonet connection, and said tool is engaged to said anode by vertical mating and then relative rotation.

19. The method according to claim 16 comprising the further steps of:

providing a diffusion plate support extending above said anode;

providing that said diffusion plate and said diffusion plate support have engageable portions which together define a bayonet connection;

lowering said diffusion plate through said open top to engage said portions in a vertical direction; and turning said diffusion plate with respect to said diffusion plate support to fully engage said portions.

20. The method according to claim 19 comprising the further steps of:

providing a tool which engages and holds said diffusion plate and which includes a handle;

engaging said tool to said diffusion plate and holding said diffusion plate with said tool;

and said steps of lowering and turning said diffusion plate are undertaken by force exerted on said diffusion plate by said tool; and disengaging said tool from said diffusion plate.

21. The method according to claim 20 wherein said step of engaging said tool to said diffusion plate is further defined in that said tool and said diffusion plate include between them interacting portions which together define a bayonet connection, and said tool is engaged to said diffusion plate by vertical mating and then relative rotation.

22. The method of claim 16 wherein providing an anode includes providing an anode having an electrically conductive portion and a shield portion, the shield portion and the anode support having the engageable parts that define the bayonet connection.

23. A reactor for electroplating a microelectronic workpiece, comprising:

a vessel;

a cup for holding a supply of process fluid, said cup held within said vessel;

an anode located within said cup and having a top surface and a bottom surface;

an anode support mechanically connected to said anode by a connection adapted to be positioned into a fully engaged condition from a fully disengaged condition by relative axial motion and rotation of the anode support and the anode of less than 360 degrees to engage interengaging portions of said anode support with interengaging portions of said anode a tool engagable to said anode from a top side thereof to rotate said anode conjointly with said tool.

24. The reactor according to claim 23 wherein said tool and said anode carry interengaging portions which together define a bayonet connection, said tool and said anode lockable together by vertical mating and then relative rotation.

25. The reactor of claim 23 wherein the anode includes an electrically conductive portion and a shield portion and further wherein the anode support is mechanically connected to the shield portion of the anode.

26. A reactor for electroplating a microelectronic workpiece, comprising:

a vessel;

a cup for holding a supply of process fluid, said cup held within said vessel;

an anode located within said cup and having a top surface and a bottom surface;

a diffusion plate and an anode shield, said anode shield arranged against said bottom surface of said anode and having brackets extending above said top surface of said anode, and said diffusion plate carried on said brackets, spaced at a distance above said top surface of said anode, wherein said diffusion plate and said brackets include interengaging parts which are alternately engaged and disengaged by relative turning between the anode and the diffusion plate; and a tool engageable to said diffusion plate from a top side thereof to rotate said diffusion plate conjointly with said tool.

27. The reactor according to claim 26, wherein said tool and said diffusion plate having interengaging portions which together define a bayonet connection, said tool and said diffusion plate lockable together by vertical mating and then relative rotation.

28. A reactor for electroplating a microelectronic workpiece, comprising:

a vessel;

a cup disposed within the vessel, the cup being configured to support a process fluid;

an anode assembly positioned within the cup and having an upwardly facing portion and a downwardly facing portion;

an anode support releasably connected to the anode assembly, one of the anode assembly and the anode support having a radially extending tab member, the other of the anode assembly and the anode support having a circumferential groove with an axial access slot, the tab member being positioned to be removably received in the access slot when at least one of the anode assembly and the anode support is moved axially relative to the other, the tab member engaging at least one surface defining the circumferential groove when at least one of the anode assembly and the anode support is rotated relative to the other to resist relative axial motion between the anode support and the anode assembly; and a tool having a tool engagement portion positioned to removably engage the upwardly facing portion of the anode assembly, the tool engagement portion being positioned to resist relative axial motion between the tool and the anode assembly upon relative rotation between the tool and the anode assembly.

29. The reactor of claim 28 wherein the anode assembly includes an electrically conductive portion and a shield portion, the shield portion having at least one bracket with a radially extending bracket tab positioned above the electrically conductive portion, and wherein the tool engagement portion includes at least one circumferential channel having an axial opening configured to receive the bracket tab.

30. The reactor of claim 28 wherein the anode assembly includes an electrically conductive portion and a shield portion, the shield portion having at least one bracket with a radially extending bracket tab positioned above the electrically conductive portion, and wherein the reactor further comprises a perforated difflusion plate having at least one circumferential channel having an axial opening configured to receive the bracket tab.

31. The reactor of claim 28 wherein the anode assembly includes an electrically conductive portion and a shield portion, the shield portion having at least one bracket with a radially extending bracket tab positioned above the electrically conductive portion, and wherein the engagement portion of the tool includes a radially extending projection, and wherein the reactor further comprises a perforated diffusion plate having at least one circumferential mounting channel having an axial opening configured to receive the bracket tab, the diffusion plate further having an opening configured to receive the projection of the tool.

* * * * *

UNITED STATES PATENT AND TRADEMARK OFFICE

CERTIFICATE OF CORRECTION

PATENT NO. : 6,280,583 B1
DATED : August 28, 2001
INVENTOR(S) : Daniel J. Woodruff et al.

It is certified that error appears in the above-identified patent and that said Letters Patent is hereby corrected as shown below:

Column 1,
Line 61, "assembly an" should be -- assembly, an --

Column 2,
Line 8, "illustrated the" should be -- illustrated, the --

Column 7,
Line 28, "7—7" should be -- 7 - 7 --
Line 30, "7A" should be -- 7A --
Line 32, "8—8" should be -- 8 - 8 --
Line 34, "along" should be -- along line --
Line 34, "9—9" should be -- 9 - 9 --

Column 11,
Line 19, "21a" should be -- 210a --
Line 23, "7A" should be -- 7A --

Column 13,
Line 53, "interenoaging" should be -- interengaging --
Line 55, "outside said" should be -- outside of said --
Line 63, "claim 2" should be -- claim 2, --

Column 14,
Line 10, "claim 5" should be -- claim 5, --
Line 25, "claim 1" should be -- claim 1, --
Line 40, "claim 8" should be -- claim 10 --
Line 49, "claim 12" should be -- claim 12, --
Line 54, "claim 1" should be -- claim 1, --
Line 59, "claim 1" should be -- claim 1, --

Column 15,
Line 18, "tool;" should be -- tool; and --
Line 19, "and said" should be -- said --
Line 23, "claim 17" should be -- claim 17, --
Line 29, "claim 16" should be -- claim 16, --
Line 41, "claim 19" should be -- claim 19, --
Line 52, "claim 20" should be -- claim 20, --
Line 58, "claim 16" should be -- claim 16, --

UNITED STATES PATENT AND TRADEMARK OFFICE

CERTIFICATE OF CORRECTION

PATENT NO. : 6,280,583 B1
DATED : August 28, 2001
INVENTOR(S) : Daniel J. Woodruff et al.

It is certified that error appears in the above-identified patent and that said Letters Patent is hereby corrected as shown below:

Column 16,
Line 9, "said anode" should be -- said anode; --
Line 12, "claim 23" should be -- claim 23, --
Line 17, "claim 23" should be -- claim 23, --
Line 63, "one" should be -- one stop --

Column 17,
Line 7, "claim 28" should be -- claim 28, --
Line 15, "claim 28" should be -- claim 28, --

Column 18,
Line 2, "difflusion" should be -- diffusion --
Line 5, "claim 28" should be -- claim 28, --

Signed and Sealed this

Twenty-ninth Day of October, 2002

*Attest:*

*Attesting Officer*

JAMES E. ROGAN
*Director of the United States Patent and Trademark Office*